US007117960B2

(12) United States Patent
Wheeler et al.

(10) Patent No.: US 7,117,960 B2
(45) Date of Patent: Oct. 10, 2006

(54) BITS FOR USE IN DRILLING WITH CASTING AND METHOD OF MAKING THE SAME

(76) Inventors: James L Wheeler, 5677 Burleigh Cres SE, Calgary, Alberta (CA) T2H 1Z7; Robin W Kapp, 5677 Burleigh Cres SE, Calgary, Alberta (CA) T2H 1Z7

( * ) Notice: Subject to any disclaimer, the term of this patent is extended or adjusted under 35 U.S.C. 154(b) by 227 days.

(21) Appl. No.: 10/804,987

(22) Filed: Mar. 22, 2004

(65) Prior Publication Data

US 2005/0103530 A1 May 19, 2005

Related U.S. Application Data

(60) Provisional application No. 60/523,144, filed on Nov. 19, 2003.

(51) Int. Cl.
*E21B 7/20* (2006.01)

(52) U.S. Cl. ..... 175/171; 175/373; 175/393; 175/394

(58) Field of Classification Search ..... None
See application file for complete search history.

(56) References Cited

U.S. PATENT DOCUMENTS 4,293,048 A * 10/1981 Kloesel, Jr. ..... 175/340

* cited by examiner

*Primary Examiner*—Zakiya W. Bates
(74) *Attorney, Agent, or Firm*—Stephen Lewellyn

(57) ABSTRACT

Bits for use in drilling with a well completion string having a bit body and a cutting face that includes a plurality of sets of cutter elements mounted on the cutting face. The bit body has a central longitudinal bore having an integrated female non-shouldered, standard oilfield completion string thread. The bits are designed with minimal cutter coverage, and this combined with the integrated completion string thread allows for economical completion of a well with high ROP expected from a PDC type bit. In an additional embodiment, a bit comprises a bit body and a cutting face having integrated cutting structures.

27 Claims, 5 Drawing Sheets

BITS FOR USE IN DRILLING WITH CASTING AND METHOD OF MAKING THE SAME

CROSS-REFERENCE TO RELATED APPLICATION

This application claims the benefit of U.S. Provisional Application No. 60/523,144, filed Nov. 19, 2003.

BACKGROUND OF THE INVENTION

1. Field of the Invention

The present invention relates generally to fixed cutter bits of the type used in cutting geological formations such as used in drilling a borehole for completing an oil well or the like. More particularly, the invention relates to fixed cutter bits for attachment to a well casing for effecting simultaneous drilling and casing of a borehole.

2. Description of the Prior Art

In drilling a borehole through a formation it is normal procedure to connect a drill bit on the lower end of an assembly of drill pipe sections which are connected end-to-end so as to form a drill string. An apparatus that is positioned above the surface of the borehole rotates the drill string. The apparatus turns the drill string and advances it downwardly, causing the bit to drill through the formation. During drilling, drilling fluid is pumped through the drill string and directed out of the bit through ports or channels formed in the bit. The drilling fluid is provided to cool the bit and to wash away cutting debris.

Once the drill string has reached a desired depth, the string is removed and a well casing is lowered into the borehole for completing the well. Depending on the required depth of the borehole, this process may need to be repeated several times to reach the desired depth. This process is normally very expensive and time consuming due to the time it takes to drill the borehole, remove the drill string and run-in the well casing. In addition, while removing the drill string and running in the well casing a cave-in can occur obstructing the well casing from advancing downward through the borehole.

With the above mentioned drawbacks, it is desirable to minimize the work and expense required to complete a well by utilizing the well casing or well liner as the drill string which is left in the borehole upon completion of drilling, thereby not requiring the use of a separate casing or liner to be run-in upon removal of the drill string.

Therefore, a need exists for a new and improved bit that can be used for drilling while casing. In this regard, the present invention substantially fulfills this need. In this respect, the bit according to the present invention substantially departs from the conventional concepts and designs of the prior art, and in doing so provides an apparatus primarily developed for the purpose of drilling while casing.

SUMMARY OF THE INVENTION

In accordance with the present invention, a bit for use in drilling a borehole using completion casing or the like in a single run is provided. The purpose of the bit of the present invention is to provide for such a bit that is economical to manufacture, is effective in drilling shallow to medium depth formations while casing and can be cemented in a borehole along with the casing. The bit is not intended to be retrieved after drilling of the borehole, and the bit is manufactured from a material which does not allow the bit to be readily drilled.

In providing this, in one embodiment, the bit comprises a bit body and a cutting face which includes a plurality of sets of cutter elements mounted on the cutting face. The bit body has a central longitudinal bore having an integrated female non-shouldered, standard oilfield completion string thread. This thread arrangement allows the bit to be secured directly to any standard completion string, well casing or tubing or can even be secured to a drill pipe through the use of a cross-over sub. The bit body can be manufactured by machining it from an alloy stock using a unique process described below or the bit body can be made by casting.

The cutting face includes at least one cutting blade extending radially therefrom. The cutting blade includes a cutting face which is adapted to receive cutter inserts, such as Polycrystalline Diamond Cutting (PDC) inserts, Tungsten Carbide (TC) inserts, Synthetic Diamond Impregnated Sintered Carbide Disks or the like. The cutting face may also be adapted to receive TC post type PDC cutters. The cutting blades also include gauge pads that are integrally formed therewith and they can be either straight or sweep-type gauge pads. The cutting faces of the blades can also use external hard metal deposition cutting faces. Preferably, three blades are used and have a blade spacing of approximately 120 degrees radially around the cutting face. The number and position of the blades can be at least one to as many as will fit along the profile and diameter of the bit. The use of three blades provides for optimization between stability of cutter position balanced with minimal coverage.

Minimal coverage, is defined as the minimum number of cutter inserts used to provide approximately 100 percent of the bottom hole surface area contact with the cutter inserts as they are rotated about the central axis of the bit. Normally, a bit that incorporates cutter inserts is designed for multiple runs in both soft shallow and medium depth harder formations. The cutter inserts therefore are spaced to reduce the amount of cutting each insert provides, thereby increasing cutter life. The bit of the present invention is designed to optimize cutter life to a single run. A few of advantages of optimizing cutter life of the bit of the present invention to a single run is found in providing for higher rates of penetration (ROP) through higher cutter loading and by providing reduced bit structure which increases manufacturing efficiency and reduced cost. However, it should be recognized that while minimal coverage bit design is most desirable, less than 100 percent coverage bit design could be used.

In an additional embodiment, the bit comprises a bit body and a cutting face having integrated cutting structures. The bit body has a central longitudinal bore having an integrated female non-shouldered, standard oilfield completion string thread. This thread arrangement allows the bit to be secured directly to any standard completion string, well casing or tubing or can even be secured to a drill pipe through the use of a cross-over sub. The bit body can be manufactured by machining it from an alloy stock using a unique process described below or the bit body can be made by casting.

In this embodiment, the integrated cutting structures extend radially from the cutting face and comprise sculptured cutting blades that are designed to be used without cutter inserts. The sculptured cutting blades also include gauge pads that are integrally formed therewith and they can be either straight or sweep-type gauge pads. The bit of this embodiment can be hardened using any case hardening technology and the integrated cutting structures can be composed entirely of hardened steel alloy. The design of the sculptured blade incorporates a structure in the blade that results in an uneven contact with the bottom hole. This pattern is designed to promote formation failure by producing ridges that can be cut away in the same manner that the cutter inserts of the above described embodiment would travel around the circumference of the bottom hole. The bit of this embodiment, incorporating the integrated cutting structures can also be manufactured using the unique manufacturing technique of the present invention described hereafter.

The unique manufacturing technique of the present invention is employed to produce the bit body's integrated female non-shouldered, standard oilfield completion string thread without the problem of eccentricity or egging of the thread. A two-step procedure is used to finish the body's blade structure before the threads are machined. The process involves, first initializing a bit blank with an inner straight bore having two concentric bores at different diameters to facilitate mounting the blank on a matching profile jig. The jig is mounted to a milling machine and the bit's outer blade geometry is machined. The diameters of the jig and the blank bore are closely toleranced to provide the needed stability in machining the blade geometry. The bit blank body thickness is much higher than when finished to prevent the body from deformation that would otherwise result from internal stress resulting from the milling operation.

Following completion of milling the blade geometry, the bit is then removed from the jig and re-mounted to complete the female thread inside the bit bore. This process is unique because prior methods of milling a bit would first begin with milling the female thread and then use the thread to mount the bit blank onto the milling machine to mill the blade geometry. This prior method cannot be used in manufacturing the bits of the present invention because the bit blank will deform and jam onto the mounting fixture during milling of the blade geometry. Therefore, the unique manufacturing technique was developed to over come the problems inherent in prior bit milling methods in order to manufacture the bits of the present invention.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
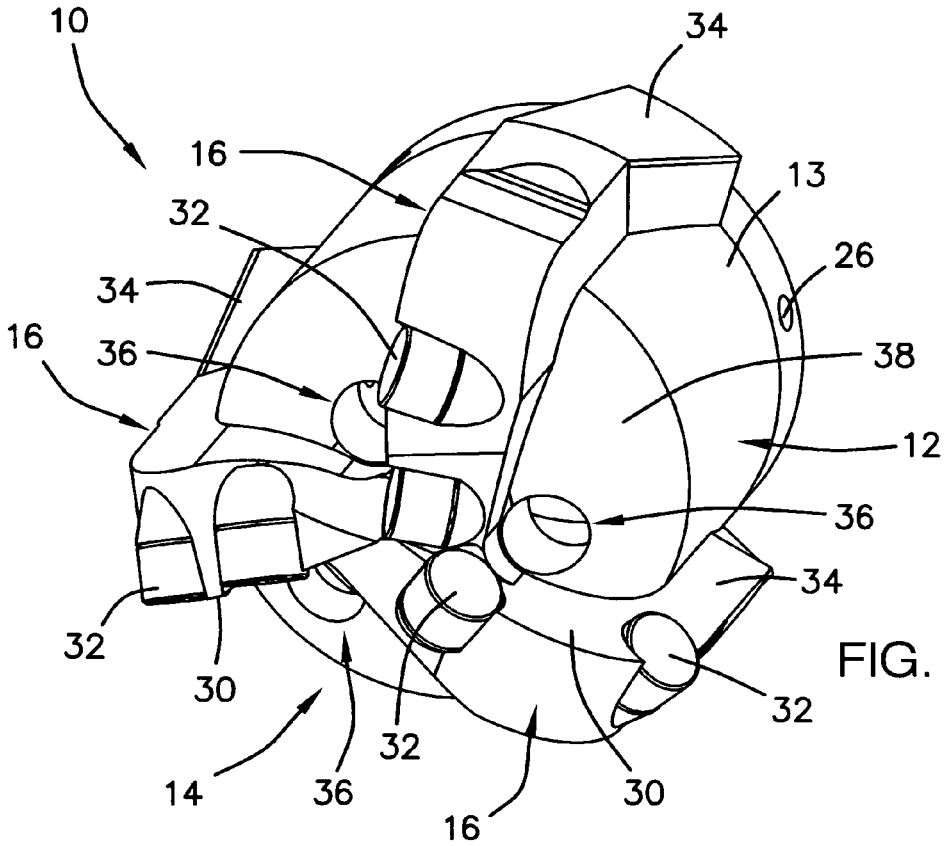
FIG. 1 is a front perspective view of a bit constructed in accordance with the principles of the present invention. The bit has a 3-blade configuration with sweep-type gauge pads and 6 cutter inserts of the PDC-type.
Figure 2:
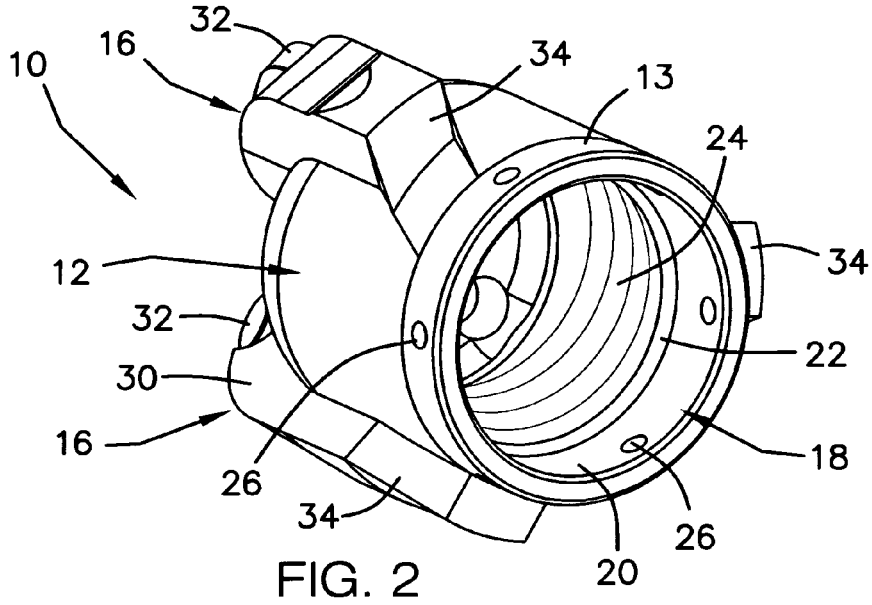
FIG. 2 is a rear perspective view of the bit illustrated in FIG. 1.
Figure 3:
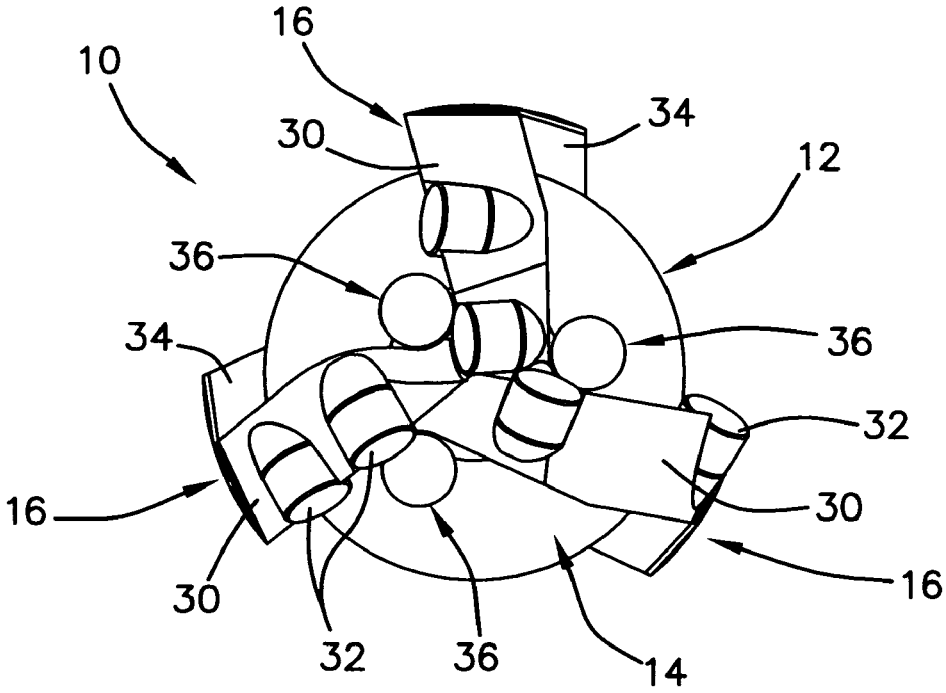
FIG. 3 is a front elevation view of the bit illustrated in FIG. 1.

Referring now to the drawings, and particularly to FIGS. 1–3, a preferred embodiment of the bit that can be used for drilling while casing of the present invention is shown and generally designated by the reference numeral 10. Briefly, the bit 10 is referred to in the art as a drag bit or fixed cutter bit and is intended to be economical to manufacture, effective in drilling shallow to medium depth formations while casing and can be cemented in a borehole along with the casing. The bit 10 is not intended to be retrieved after drilling of the borehole, and the bit is manufactured from a material which does not allow the bit to be readily drilled.

The bit 10 is designed to be used with a standard well completion strings and used for drilling a borehole using the completion string as a drill string. In use, the bit 10 is fixed to the leading end of the completing strings using a standard female thread and is rotated with the string using a rotation platform positioned above the borehole. The use of equipment positioned down hole for rotating the bit is eliminated making the application of the bit less expensive and complicated. The bit 10 is for use in drilling while casing applications where a borehole is required to be drilled in a medium to shallow depth formation. Once the borehole has reached the required depth, the bit 10 is cemented in along with the completion string, it is not retrieved before the cementing operation.

More particularly, the bit 10 has a bit body 12 having an outer surface 13 with a first diameter and a cutting face 14 which includes a plurality cutting blades 16 which extend radially therefrom. The cutting blades 30 can be either straight or swept. The bit body 12 has a central, longitudinal bore 18 having an inner face 20 of a second diameter and a thread start taper shoulder 22 having a third diameter that is less than the first diameter of the bit body 12 and greater than the second diameter of the inner face 20. The inner face 20 includes integrated female threads 24 which are non-shoulder, standard oilfield completion string threads. The threads 24 provide for a threaded coupling of the bit 10 to any standard completion string, well casing or well tubing. The bore 18 and threads 24 can be machined to accept any standard well casing or completion string diameters or can be custom machined for specific applications. Preferably, the threads 24 are either API NUE round thread or API round casing thread.

The bit body 12 includes a plurality of through holes 26 for securing the bit to the jig during manufacturing thereof. The through holes 26 are formed through the bit body 12 towards the proximal end and radially thereof. The through holes 26 extend through the end of the bit body 12 from the outer surface 13 to the shoulder surface 22.

The cutting face 14 includes at least one cutting blade 16 extending radially therefrom. Each cutting blade 16 has a cutting face 30 that is adapted to receive cutter inserts 32. The cutter inserts as illustrated in this figure are of the Polycrystalline Diamond Cutting (PDC) type. However, the cutter inserts can be selected from Polycrystalline Diamond Cutting (PDC) inserts, Tungsten Carbide (TC) inserts, Synthetic Diamond Impregnated Sintered Carbide Disks or TC post type PDC inserts. The bit 10 illustrated in FIGS. 1 and 2, includes 2 cutter inserts 32 per each cutting blade 16 for a total of 6 cutter inserts. However, as it will be discussed in further detail, there is no limit to the number of cutter inserts 32 placed on each blade 16 and the number of inserts used does not have to be same for each blade. For example, one blade 16 may only have one cutter insert 32 while another may use 3 inserts.

Minimal coverage, is defined as the minimum number of cutter inserts 32 used to provide approximately 100 percent of the bottom hole surface area contact with the cutter inserts as they are rotated about the central axis of the bit 10. Normally, a bit that incorporates cutter inserts is designed for multiple runs in both soft shallow and medium depth harder formations. The cutter inserts therefore are spaced to reduce the amount of cutting each insert provides, thereby increasing cutter life. The bit 10 of the present invention is designed to optimize cutter insert 32 life to a single run. A few advantages of optimizing cutter life of the bit 10 of the present invention to a single run is found in providing for higher rates of penetration (ROP) through higher cutter loading and by providing reduced bit structure which increases manufacturing efficiency and reduced cost. Minimal coverage bit design combined with the integrated completion string thread 24 allows economical completion of a well with the high ROP expected from a PDC type bit.

The cutting blade 16 also includes integral gauge pads 34 and they can be either straight or sweep-type (spiral) pads. The gauge pads 34 are used to help stabilize the bit 10 against the borehole during drilling operations. While the bit 10 as illustrated in FIGS. 1 and 2, includes 3 cutting blades 16, the number and position of the blades can be at least one to as many as will fit along the profile and diameter of the bit 10. The blade spacing is preferably adjusted off symmetry to reduce harmonic vibration. It has been found the use of three blades 16 provides for optimization between stability of cutter position balanced with minimal coverage.

The cutting face 30 of the blades 16 can also be hardened with external hardface deposition. External hardface deposition is typically used in the manufacture of articles that require a very high degree of hardness and need to be resistant to wear under heavy loading. External hard face deposition can be comprised of tungsten particles bonded in a pure nickel core matrix and is typically used as a surface coating that is applied to a substrate to increase the hardness thereof.

The bit body 12 also includes plurality of integrated nozzles 36 formed through a distal end 38 of the bit body. The nozzles 36 allow drilling fluid to flow through the end 38 into the borehole to cool the bit and to wash away cutting debris toward the surface of the borehole. In addition, the nozzles 36 provide for the flow of cement pumped into the completing string through the end 38 of the bit into the borehole during cement operations. The nozzles are preferably formed through the end 38 between every cutting blade 16. However, the number of and the spacing of the nozzles 36 can by adjusted for the required application.

The bit 10 can be manufactured by machining it from an alloy stock using a unique process or the bit body can be made by casting. The unique manufacturing technique of the present invention is employed to produce the bit body's 12 integrated female non-shouldered, standard oilfield completion string thread 24 without the problem of eccentricity or egging of the thread. A two-step procedure is used to finish the body's blade structure before the threads are machined. The process involves, first initializing a bit blank with an inner straight bore having two concentric bores at different diameters to facilitate mounting the blank on a matching profile jig. The jig is mounted to a milling machine and the bit's outer blade geometry is machined. The diameters of the jig and the blank bore are closely toleranced to provide the needed stability in machining the blade geometry. The bit blank body thickness is much higher than when finished to prevent the body from deformation that would otherwise result from internal stress from the milling operation.

Following completion of milling the blade geometry, the bit 10 is then removed from the jig and re-mounted to complete the female thread 24 inside the bit bore 18. This process is unique because prior methods of milling a bit would first begin with by milling the female thread 24 and then use the thread to mount the bit blank onto the milling machine to mill the blade geometry. This prior method cannot be used in manufacturing the bits of the present invention because the bit blank will deform and jam into the mounting fixture during milling of the blade geometry. Therefore, the unique manufacturing technique was developed to over come the problems inherent in prior bit milling methods in order to manufacture the bits of the present invention.

Figure 4:
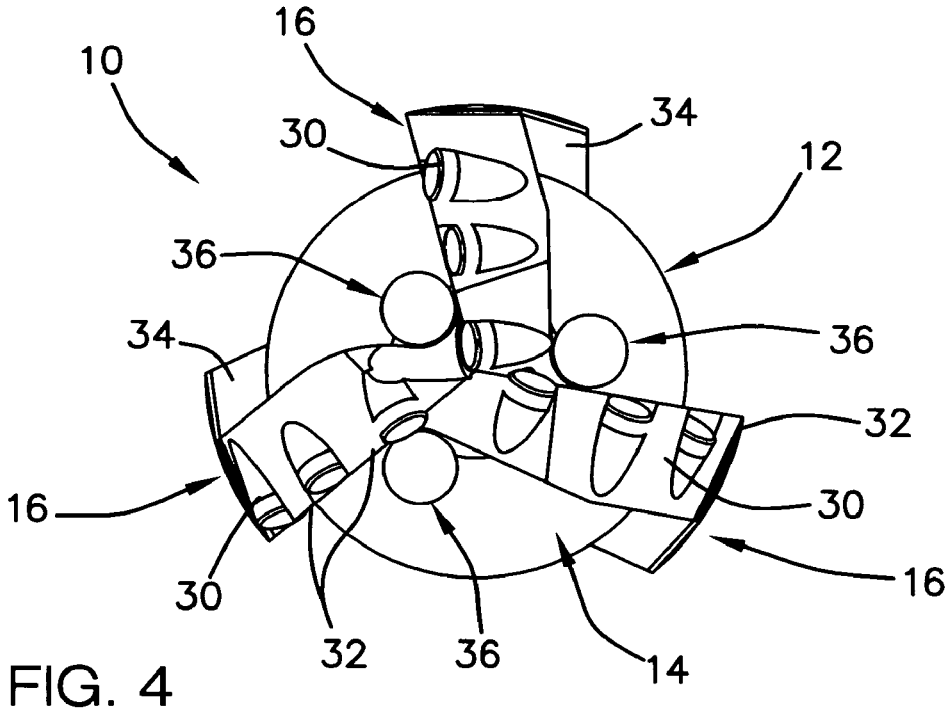
FIG. 4 is a front elevation view of an alternate bit of the present invention. The bit has 3-blade configuration with sweep-type gauge pads and 9 cutter inserts of the synthetic diamond impregnated sintered carbide type.
Figure 5:
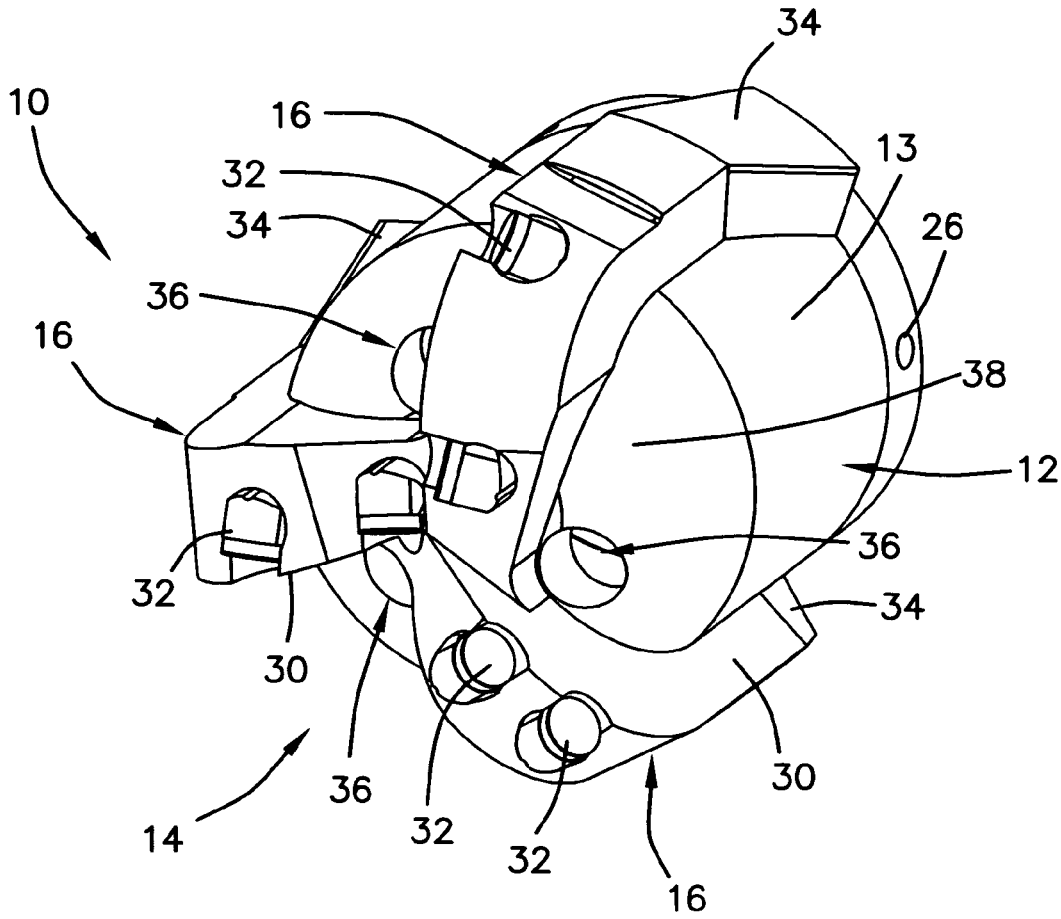
FIG. 5 is a front perspective view of an alternate bit of the present invention. The bit has a 3-blade configuration with sweep-type gauge pads and 6 cutter inserts of the TC post-type.

Now referring to FIGS. 4 and 5, an alternate embodiment of the bit 10 is illustrated. More particularly, the bit 10 includes three cutting blades 16 having a sweep-type gauge pad 34. It is noted that the sweep-type pad 34 can be replaced with a straight gauge pad in this embodiment and any other embodiments described herein. The cutting blades 16 are each fitted with 3 cutter inserts 32 of the synthetic diamond impregnated sintered carbide type. The cutter inserts 32 can be selected from Polycrystalline Diamond Cutting (PDC) inserts, Tungsten Carbide (TC) inserts, Synthetic Diamond Impregnated Sintered Carbide Disks or TC post type PDC inserts. The same basic structure exists with this bit 10 as the bit illustrated in FIGS. 1, 2 and 3 and as described above. The main difference being the number of cutter inserts 32 used and the placement thereof along the cutting blades.

Figure 6:
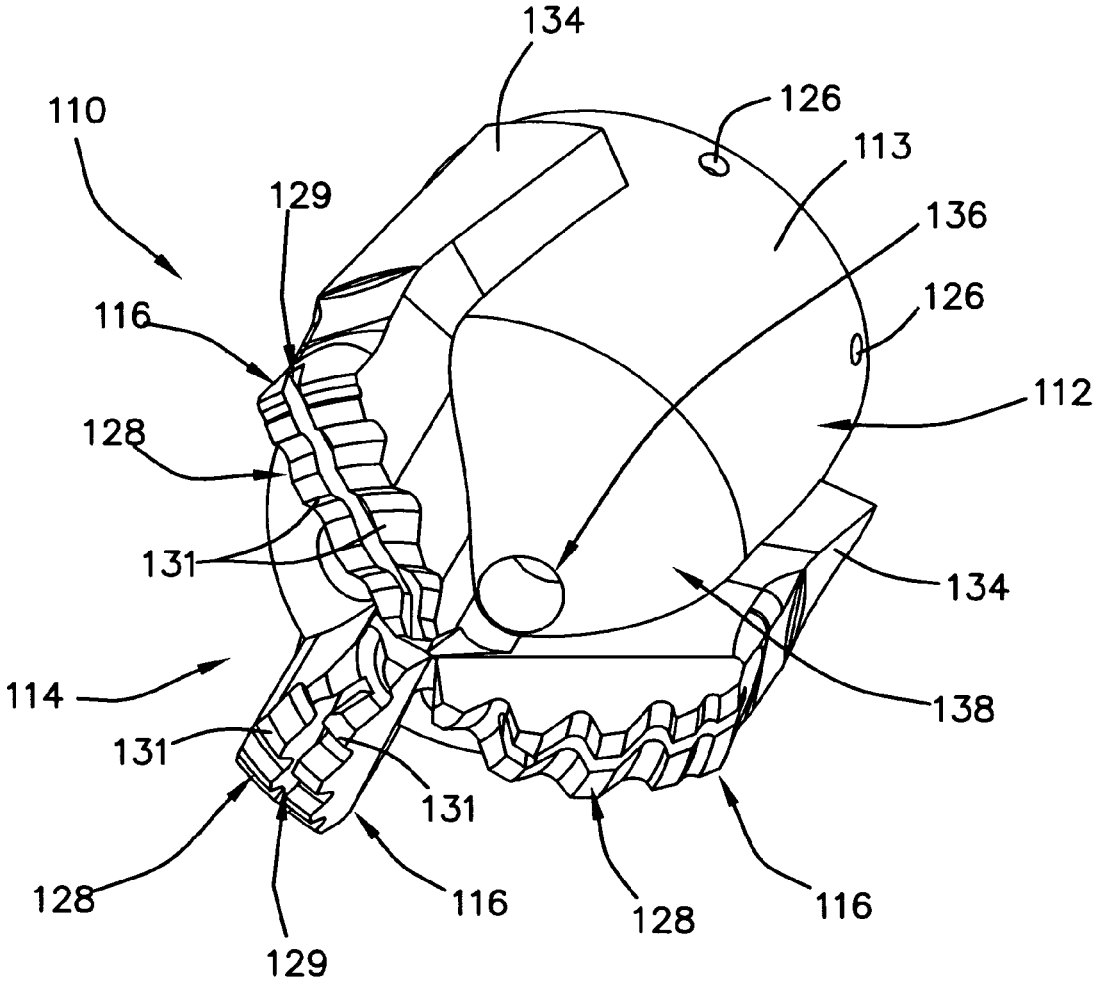
FIG. 6 is a front perspective view of the sculptured blade bit constructed in accordance with the principles of the present invention. The bit has a 3-blade configuration and a sweep-type gauge pad.
Figure 7:
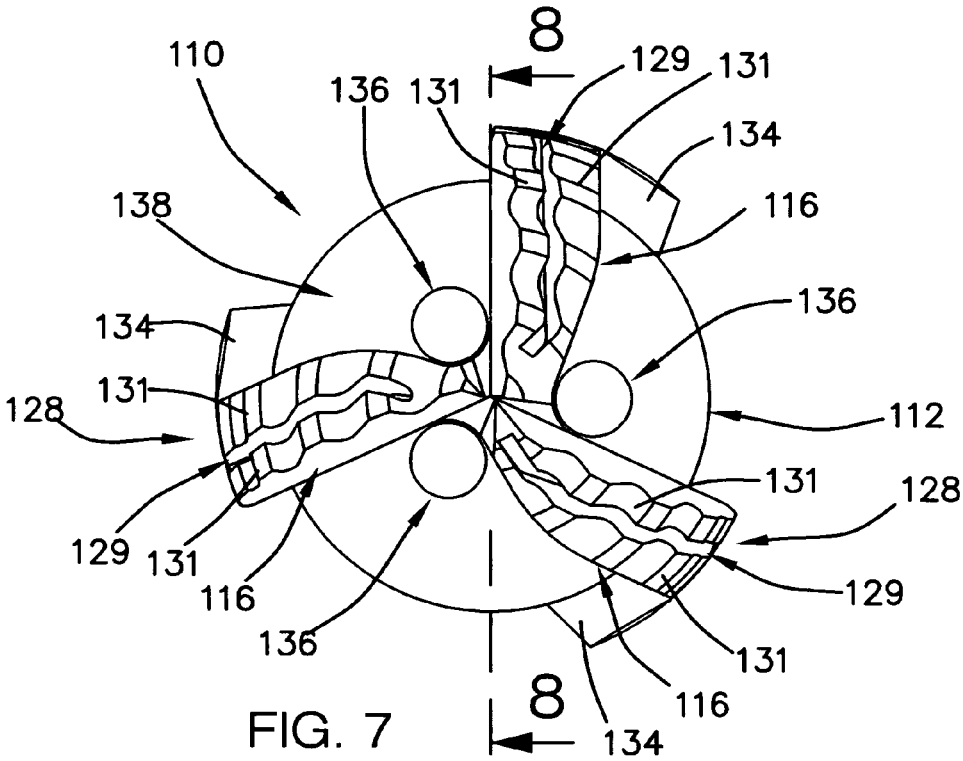
FIG. 7 is a front elevation view of the bit illustrated in FIG. 6.
Figure 8:
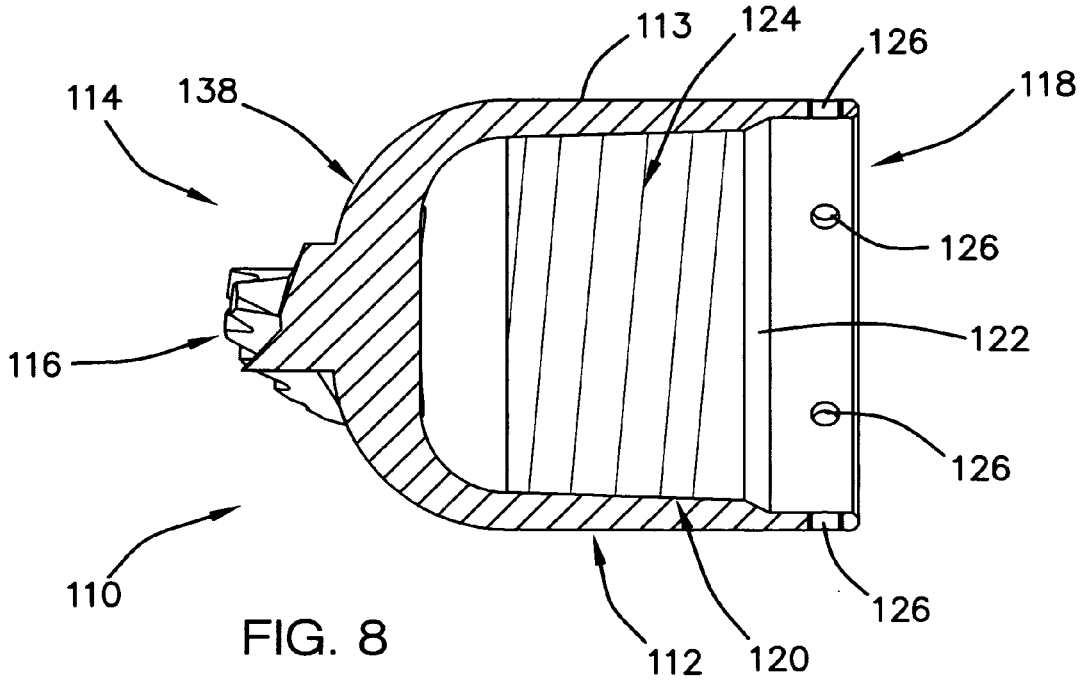
FIG. 8 is a cross sectional view taken along line 8—8 in FIG. 7.

Referring to FIGS. 6, 7 and 8, an alternate bit 110 of the present invention is illustrated and will be described. More particularly, the bit 110 includes a bit body 112 having an outer surface 113 with a first diameter and a cutting face 114. The cutting face 114 includes a plurality of cutting blades or integrated cutting surfaces 116 that extend radially therefrom. The bit body 112 has a central, longitudinal bore 118 having an inner face 120 of a second diameter and a thread start taper shoulder 122 having a third diameter that is less than the first diameter of the bit body 112 and greater then the second diameter of the inner face 120. The inner face 120 includes integrated female threads 124 which are non-shoulder, standard oilfield completion string threads. The threads 124 provide for a threaded coupling of the bit 110 to any standard completion string, well casing or well tubing.

The bit body 112 includes a plurality of through holes 126 for securing the bit to the jig during manufacturing thereof. The through holes 126 are formed through the bit body 112 towards the proximal end and radially thereof. The through holes 126 extend through the end of the bit body 112 from the outer surface 113 to the shoulder surface 122.

The cutting face 114 includes at least one cutting blade 116 extending radially therefrom and has a sculptured cutting edge 116. The sculptured edge can include a longitudinal slot 129 formed therein, thereby creating two cutting edges 131 for each cutting blade 116. The sculptured cutting blades 116 are designed for use without cutter inserts. This design incorporates a sculptured blade 116 pattern that results in an uneven contact with the bottom of the borehole. This pattern design is to promote formation failure by producing ridges that can be cut away in the same way that the cutter inserts would traveling around the circumference of the borehole. The bit 110 of this embodiment can include any material case hardening and the integrated cutting structures can be composed entirely of hardened steel alloy, and can be manufacture using the unique manufacturing process as described above. The bit 110 can also be hardened using any material case hardening technology.

The cutting blades 116 can either straight or swept and can also include integral gauge pads 134. The gauge pads 134 can be either straight or sweep-type (spiral) pads. The gauge pads 134 are used to help stabilize the bit 110 against the borehole during drilling operations. While the bit 110 as illustrated in FIGS. 6, 7 and 8, includes 3 cutting blades 116, the number and position of the blades can be at least one to as many as will fit along the profile and diameter of the bit 110. Preferably, three cutting blades 116 are used and have a blade spacing of approximately 120 degrees radially around the cutting face 114. It has been found the use of three blades 116 provides for optimization between stability of cutter position balanced with minimal coverage.

The bit body 112 also includes plurality of integrated nozzles 136 formed through the end 138 of the bit body. The nozzles 136 allow drilling fluid to flow through the end 138 into the borehole to cool the bit and to wash away cutting debris toward the surface of the borehole. In addition, the nozzles 136 provide for the flow of cement pumped into the completing string through the end 138 of the bit into the borehole during cement operations. The nozzles are preferably formed through the end 138 between every cutting blade 116. However, the number of and the spacing of the nozzles 136 can by adjusted for the required application.

While preferred embodiments of the bit of the present invention have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A fixed drill bit for use with a well completion suing for drilling while casing, comprising:

a bit body having an outer surface, said bit body defining a longitudinal bore, wherein the longitudinal bore includes a thread start taper shoulder at a proximal end thereof and integrated female threads;

a cutting face on the outer surface of said bit body;

said bit body having at least one nozzle formed through a distal end thereof that is in fluid communication with the longitudinal bore;

at least one cutting blade extending from said cutting face; and at least one cutter insert said at least one cutting blade adapted to receive said at least one cutting insert.

2. The fixed drill bit of claim 1, wherein said at least one cutter insert is selected from the group consisting of polycrystalline diamond cutting insert, tungsten carbine insert, synthetic diamond impregnated sintered carbide disk insert and tungsten carbine post-type polycrystalline diamond cutting insert.

3. The fixed drill bit of claim 1, wherein the bit body is of a material that is not readily drillable.

4. The fixed drill bit of claim 1, wherein said at least one cutter insert is attached to said at least one cutting blade and is positioned thereto so as to provide minimal coverage.

5. The fixed drill bit of claim 1, wherein each of said at least one cutting blade is hardened.

6. The fixed drill bit of claim 1, wherein said at least one cutting blade is hardened using external hardface deposition.

7. The fix drill hit of claim 1, wherein said at least one cutting blade includes a gauge pad formed integrally therewith.

8. A fixed drill bit for use with a well completion sting for drilling while casing comprising:

a bit body having an outer surface, said bit body defining a longitudinal bore, wherein the longitudinal bore includes a thread start taper shoulder at a proximal end thereof and integrated female threads;

a cutting face on the outer surface of said bit body;

at least three cutting blades positioned radially around said cutting face and extending therefrom;

at least one cutter insert attached to each of said at least three cutting blades; and said bit body having at least one nozzle formed through a distal end thereof that is in fluid communication with the longitudinal bore.

9. The fixed drill bit of claim 8, wherein said at least one cutter insert is selected from the group consisting of polycrystalline diamond cutting insert, tungsten carbine insert, synthetic diamond impregnated sintered carbide disk insert and tungsten carbine post-type polycrystalline diamond cutting insert.

10. The fixed drill bit of claim 8, wherein said at least three cutting blades are positioned off symmetry radially around said cutting face.

11. The fixed drill bit of claim 8, wherein said at least one cutter insert is attached to each of said at least three cutting blades is positioned thereto so as to provide minimal coverage.

12. The fixed drill bit of claim 8, wherein each of said at least three cutting blades are hardened.

13. The fixed drill bit of claim 12, wherein each of said at least three cutting blades are hardened using external hardface deposition.

14. The fixed drill bit of claim 8, wherein said bit body is of a material that is not readily drillable.

15. The fix drill bit of claim 8, wherein each of said at least three cutting blades includes a gauge pad formed integrally therewith.

16. A fixed drill bit for use with a well completion string for drilling while casing comprising:

a bit body having an outer surface, said bit body defining a longitudinal bore, wherein the longitudinal bore includes a thread start taper shoulder at a proximal end thereof and integrated female threads;

a cutting face on the outer surface of said bit body;

said bit body having at least one nozzle formed through a distal end thereof that is in fluid communication with the longitudinal bore; and at least one cutting blade extending from said cutting face, said cutting blade having a sculptured cutting edge.

17. The fixed drill bit of claim 16, wherein said bit body is of a material that is not readily drillable.

18. The fixed drill bit of claim 16, wherein the sculptured cutting edge of said at least one cutting blade is of a pattern so as to provide minimal coverage.

19. The fixed drill bit of claim 16, wherein the sculptured cutting edge of said at least one cutting blade includes a longitudinal slot.

20. The fixed drill bit of claim 16, wherein said bit body and said at least one cutting blade is hardened.

21. The fixed drill bit of claim 16, wherein said at least one cutting blade includes a gauge pad formed integrally therewith.

22. A fixed drill bit for use with well a completion string for drilling while casing comprising:

a bit body having an outer surface, said bit body defining a longitudinal bore, wherein the longitudinal bore includes a thread start taper shoulder at a proximal end thereof and integrated female treads;

a cutting face on the outer surface of said bit body;

said bit body having at least one nozzle formed through a distal end thereof that is in fluid communication with the longitudinal bore; and at least three cutting blades positioned radially round said cutting face and extending therefrom, said at least three cutting blades having a sculptured cutting edge.

23. The fixed drill bit of claim 22, wherein said bit body is of a material that is not readily drillable.

24. The fixed drill bit of claim 22, wherein the sculptured cutting edges of said at least three cutting blades are of a pattern so as to provide minimal coverage.

25. The fixed drill bit of claim 22, wherein the sculptured cutting edge of each of said at least three cutting blades includes a longitudinal slot.

26. The fixed drill bit of claim 22, wherein said bit body and said at least three cutting blades are hardened.

27. The fixed drill bit of claim 22, wherein each of said at least three cutting blades includes a gauge pad formed integrally therewith.

* * * * *

UNITED STATES PATENT AND TRADEMARK OFFICE

CERTIFICATE OF CORRECTION

PATENT NO. : 7,117,960 B2
APPLICATION NO. : 10/804987
DATED : October 10, 2006
INVENTOR(S) : James Wheeler It is certified that error appears in the above-identified patent and that said Letters Patent is hereby corrected as shown below:

Claim 1, column 8, line 18, please delete “suing” and replace with --string --

Claim 8, column 8, line 51, please delete “sting” and replace with --string --

Signed and Sealed this

Tenth Day of April, 2007

JON W. DUDAS
*Director of the United States Patent and Trademark Office*